US008690289B1

(12) United States Patent
Kuo

(10) Patent No.: US 8,690,289 B1
(45) Date of Patent: Apr. 8, 2014

(54) PRINTING DEVICE AND PRINTER USING THE SAME

(71) Applicant: Kinpo Electronics, Inc., New Taipei (TW)

(72) Inventor: Yu-Hsiang Kuo, New Taipei (TW)

(73) Assignee: Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 13/772,369

(22) Filed: Feb. 21, 2013

(30) Foreign Application Priority Data

Dec. 3, 2012 (TW) ..... 101145271 A

(51) Int. Cl.
*B41J 2/165* (2006.01)

(52) U.S. Cl.
USPC ..... 347/29; 347/33

(58) Field of Classification Search
USPC ..... 347/22–29, 33–37, 40, 42, 49, 53, 67
See application file for complete search history.

(56) References Cited

U.S. PATENT DOCUMENTS 5,764,265 A 6/1998 Minegishi et al.
6,883,895 B2 * 4/2005 Murakami et al. ..... 347/29

* cited by examiner

*Primary Examiner* — Thinh Nguyen
(74) *Attorney, Agent, or Firm* — Jianq Chyun IP Office

(57) ABSTRACT

A printing device and a printer using the same are provided. The printer includes a body and the printing device installed therein. The printing device includes a shaft, an inkjet module disposed on the shaft, and a cleaning module disposed under the shaft. The inkjet module has a nozzle and at least one electromagnet around the nozzle. The cleaning module includes a scraper and a cap disposed aside of the scraper, wherein the cap is magnetic or has at least one magnet disposed therein. Whether the cap attracts the nozzle or the cap repels the nozzle is determined by the current applied to the electromagnet.

18 Claims, 8 Drawing Sheets

PRINTING DEVICE AND PRINTER USING THE SAME

CROSS-REFERENCE TO RELATED APPLICATION

This application claims the priority benefit of Taiwan application serial no. 101145271, filed on Dec. 3, 2012. The entirety of the above-mentioned patent application is hereby incorporated by reference herein and made a part of this specification.

BACKGROUND OF THE INVENTION

1. Field of the Invention

The present invention relates to a printing device and a printer. More particularly, the present invention relates to a printing device characterized by superior sealing precision and a printer using the printing device.

2. Description of Related Art

The situations of nozzle jammed or ink therein drying up, etc., are easily happened to a nozzle of an inkjet printer if the nozzle is not in use for a long period of time, such that it may not be able to perform the normal printing processes or maintain satisfactory printing quality. Thus, the printers available in the market nowadays adopt the design of caps engaged with the nozzles regarding this issue, so as to avoid exposing nozzle which leads to the problems of nozzle jammed or ink drying out, etc.

At present, a nozzle commonly adopts a motor coupled to a mechanism composed of tens of components such as gear assembly, rack, shaft, sliding rail, belt, etc., to drive a scraper of a cleaning module to perform a cleaning process on the nozzle, and then the nozzle is sealed by a cap, such that the nozzle maintains airtight to prevent the ink from drying out when no printing process is performed.

FIG. 1 is a schematic view of a conventional printing device, and FIG. 2 is a schematic view illustrating the operation in sequence of a cleaning module. Referring to both FIG. 1 and FIG. 2, currently, the industry mainly uses a motor 100 to conduct a gear (not shown) disposed under the motor 100 to drive the mechanism composed of the components such as rack (not shown), sliding rail (not shown), etc., so as to drive the printing module 110 to perform a printing process. After the printing process is finished, the printing module 110 is moved to a certain position, and the cleaning module 120 is firstly moved along X-direction for the scraper 122 to firstly scrape the residuary ink on a nozzle (not shown), and then the cleaning module 120 is moved along Y-direction for pre-alignment, the inner casing 124 of the cleaning module 120 is moved along X-direction again so the cap 126 is aligned with the nozzle (not shown). Next, the cap 126 is moved close to the nozzle (not shown) along Z-direction and seals the nozzle (not shown).

According to the description above, the cleaning module needs to perform at least four operations respectively along X, Y, Z directions to be able to seal the nozzle by the cap.

SUMMARY OF THE INVENTION

The present invention provides a printing device having a nozzle and a cap with superior sealing precision.

The present invention provides a printer, which the printing device thereof has a nozzle and a cap with superior sealing precision.

The present invention provides a printing device including a shaft, an inkjet module and a cleaning module. The inkjet module is disposed on the shaft such that the inkjet module is capable of moving back and forth along an axial direction of the shaft. The inkjet module has a nozzle and an electromagnet disposed around the nozzle. The cleaning module is disposed below the shaft and includes a scraper and a cap disposed at one side of the scraper. The cap is magnetic.

The invention further provides a printer including a body and a printing device disposed in the body. The printing device includes a shaft, an inkjet module and a cleaning module. The inkjet module is disposed on the shaft such that the inkjet module is capable of moving back and forth along an axial direction of the shaft. The inkjet module has a nozzle and at least one electromagnet disposed around the nozzle. The cleaning module is disposed below the shaft and includes a scraper and a cap disposed at one side of the scraper. The cap is magnetic.

The present invention further provides a printing device including a shaft, an inkjet module and a cleaning module. The inkjet module is disposed on the shaft to move back and forth along an axial direction of the shaft. The inkjet module has a nozzle and at least one electromagnet. The electromagnet is disposed around the nozzle. The cleaning module is disposed below the shaft and includes a scraper, a cap and at least one permanent magnet. The cap is disposed at one side of the scraper, wherein the permanent magnet is engaged in the cap, and when the inkjet module moves along the shaft to a location above the cleaning module, the position of the permanent magnet corresponds to the position of the electromagnet.

The invention further provides a printer including a body and a printing device disposed in the body. The printing device includes a shaft, an inkjet module and a cleaning module. The inkjet module is disposed on the shaft to move back and forth along an axial direction of the shaft. The inkjet module has a nozzle and at least one electromagnet. The electromagnet is disposed around the nozzle. The cleaning module is disposed below the shaft and includes a scraper, a cap and at least one permanent magnet. The cap is disposed at one side of the scraper, wherein the permanent magnet is engaged in the cap, and when the inkjet module moves along the shaft to a location above the cleaning module, the position of the permanent magnet corresponds to the position of the electromagnet.

Based on the description above, in the printing device and the printer using the printing device of the present invention, the electromagnet is disposed around the nozzle to use the property of the electromagnet to generate attraction or repellence between the electromagnet and the cap with magnet disposed therein or being magnetic by controlling the forward direction and the reverse direction of the current, so as to seal or unseal the nozzle.

In order to make the aforementioned and other features and advantages of the invention more comprehensible, embodiments accompanying figures are described in detail below.

DESCRIPTION OF EMBODIMENTS

A conventional printer uses the mechanism composed of components such as motor, gear assembly, rack, shaft, sliding rail, belt, etc., interfered with each other to drive the cleaning module to move along X-direction to a certain position, and then move along Y-direction to drive the scraper to scrape the residuary ink on the nozzle. Afterward, the operation of the mechanism enables the cap to move along Z-direction so as to seal the nozzle. However, in the printing device and the printer using the printing device of the present invention, the cleaning module only moves relative to the nozzle along Y-direction when the scraper scrapes the residuary ink, and then the nozzle moves along Z-direction to be engaged with the cap by using the magnetic attraction or magnetic repellence. Compared with the prior art, the printing device and the printer using the printing device of the present invention have the advantages such as having less amount of the components configured to drive the cleaning module and simple disposition of the components, etc., since the cleaning module is not required to move along X-direction and is only required to move along Y-direction and Z-direction.

Thereinafter, embodiments are recited to describe the concepts of the present invention in further details. The following embodiments are only for explanation and presented as examples, but not intended to limit the scope of the invention. Moreover, the descriptions used to describe the relationships of the relative positions between components such as front, back, up, down, left, right, or the like, and the directional terms such as X-direction, Y-direction, Z-direction, etc., in the following description are regarded in an illustrative sense with reference drawings rather than in a restrictive sense.

First Embodiment

Figure 1:
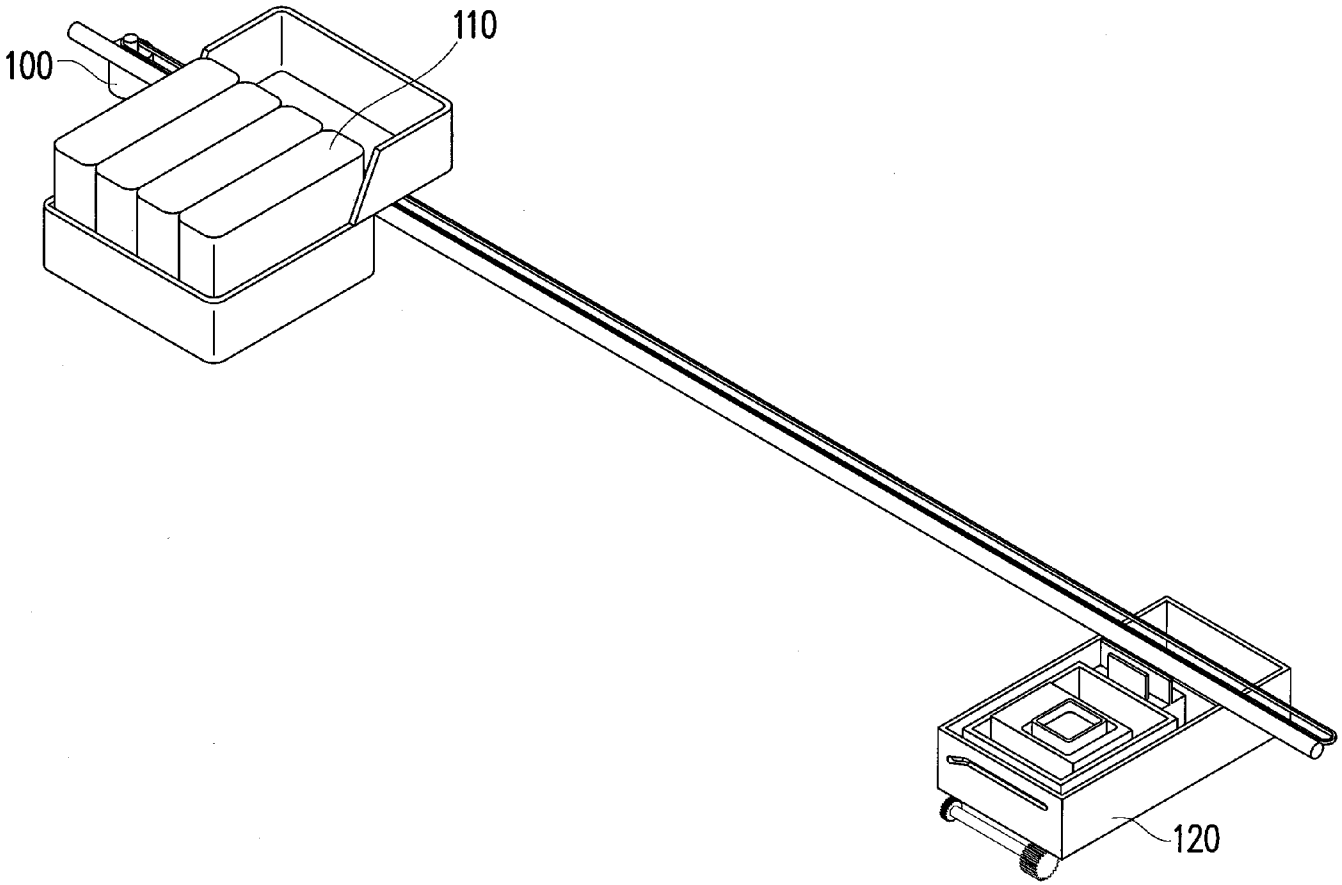
FIG. 1 (RELATED ART)
FIG. 1 illustrates a schematic view of a conventional printing device.
Figure 2:
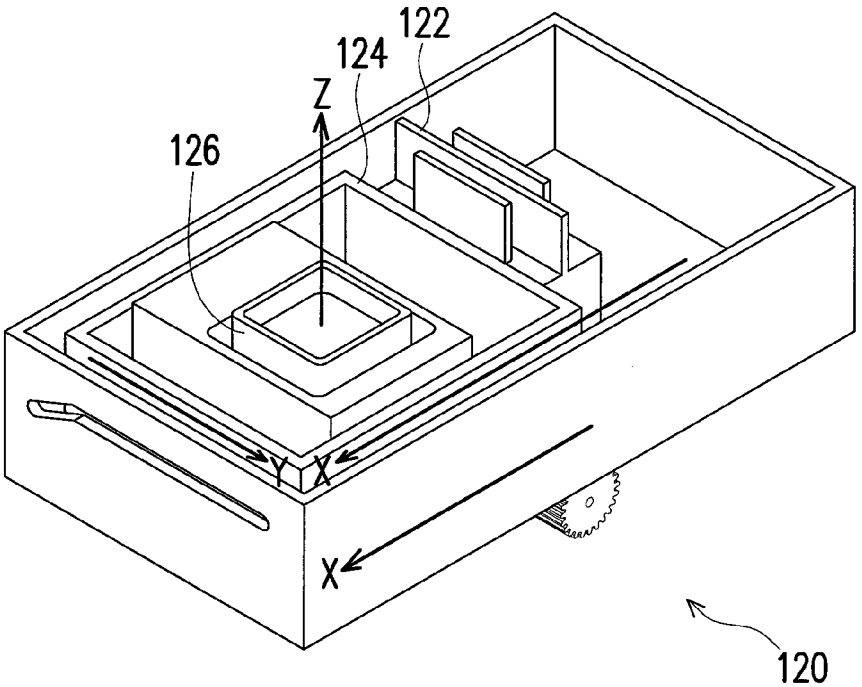
FIG. 2 (RELATED ART)
FIG. 2 is a schematic view illustrating the operation in sequence of a cleaning module.
Figure 3:
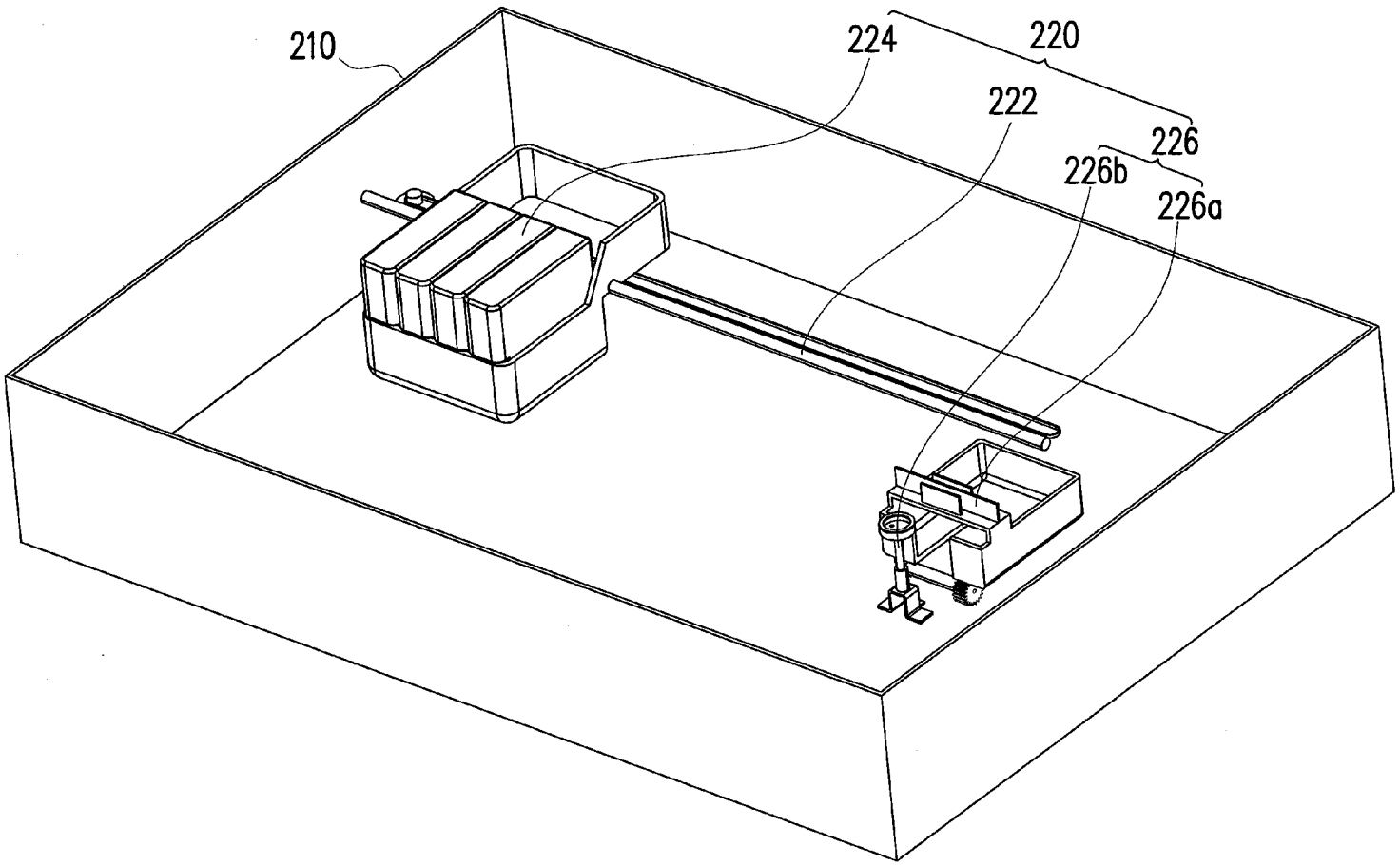
FIG. 3 is a schematic view of a printer according to a first embodiment of the present invention.
Figure 4:
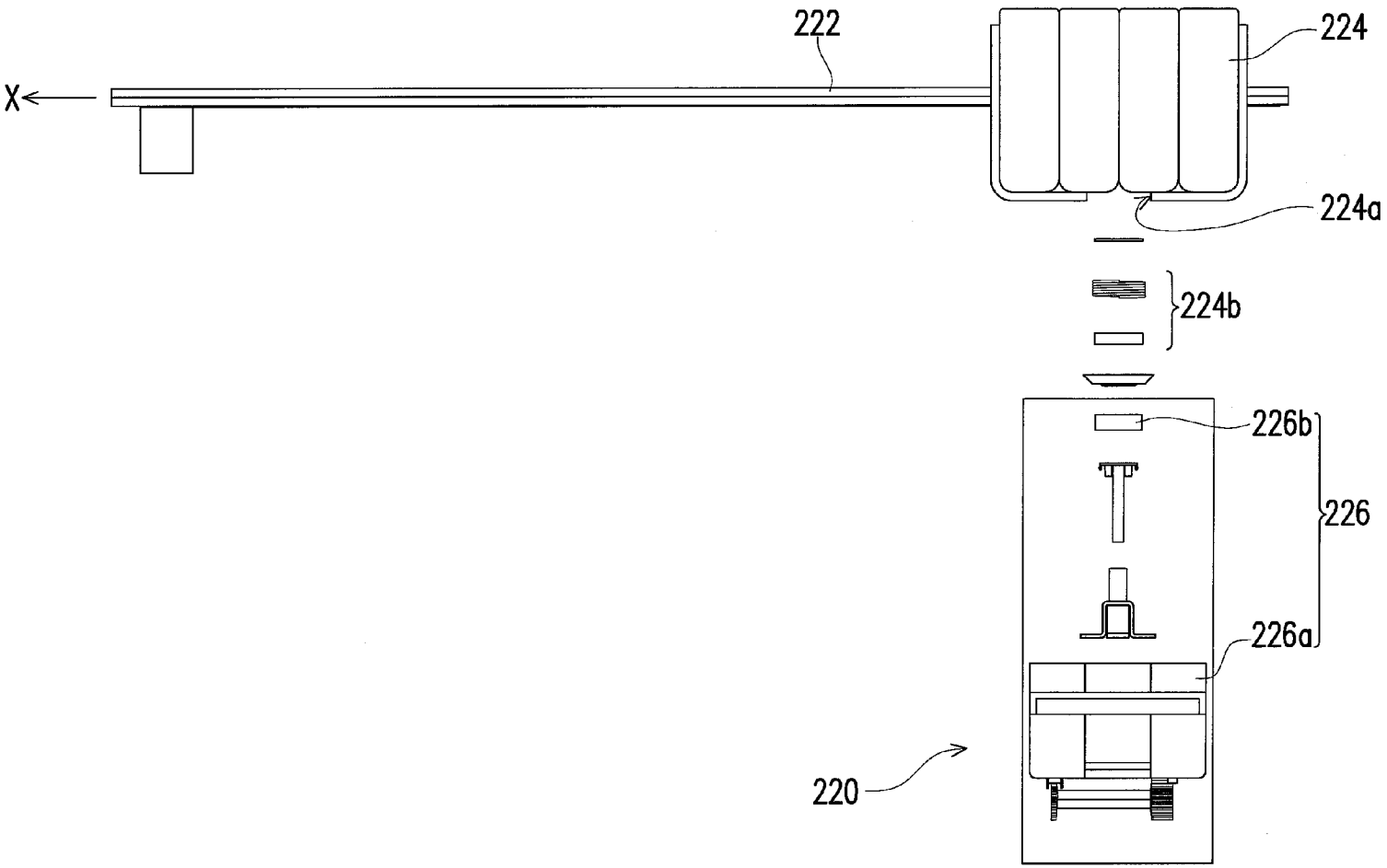
FIG. 4 is a schematic exploded view of an inkjet module and a cleaning module.

FIG. 3 is a schematic view of a printer according to a first embodiment of the present invention, and FIG. 4 is a schematic exploded view of an inkjet module and a cleaning module. Referring to both FIG. 3 and FIG. 4, the printer 200 includes a body 210 and a printing device 220 disposed in the body 210, wherein the printing device 220 includes a shaft 222, an inkjet module 224 and a cleaning module 226. The shaft 222 is fixed in the body 210, and the inkjet module 224 is disposed on the shaft 222, and when the printer 200 performs a printing process, the inkjet module 224 moves back and forth along an axial direction (X-direction) of the shaft 222. The inkjet module 224 has a nozzle 224*a* and an electromagnet 224*b* disposed around the nozzle 224*a*. The cleaning module 226 is disposed below the shaft 222 and includes a scraper 226*a* and a cap 226*b* disposed at one side of the scraper 226*a*. The cap 226*b* is magnetic.

In detail, the electromagnet 224*b* is disposed on the nozzle 224*a*, so that the electromagnet 224*a* is in circular shape corresponding to the shape of the nozzle 224*a*, and the electromagnet 224*b* is composed of a core and a coil, wherein the nozzle 224*a* passes through the core. The material of the cap 226*b* includes magnetic material, and the cap 226*b* may be formed in shape by mixing the magnetic material and the plastic material together, wherein the magnetic material includes steel, iron, nickel, aluminum, cobalt, aluminum-nickel-cobalt alloy, titanium-cobalt alloy, platinum-cobalt alloy or rare-earth elements and cobalt alloy.

Figure 5:
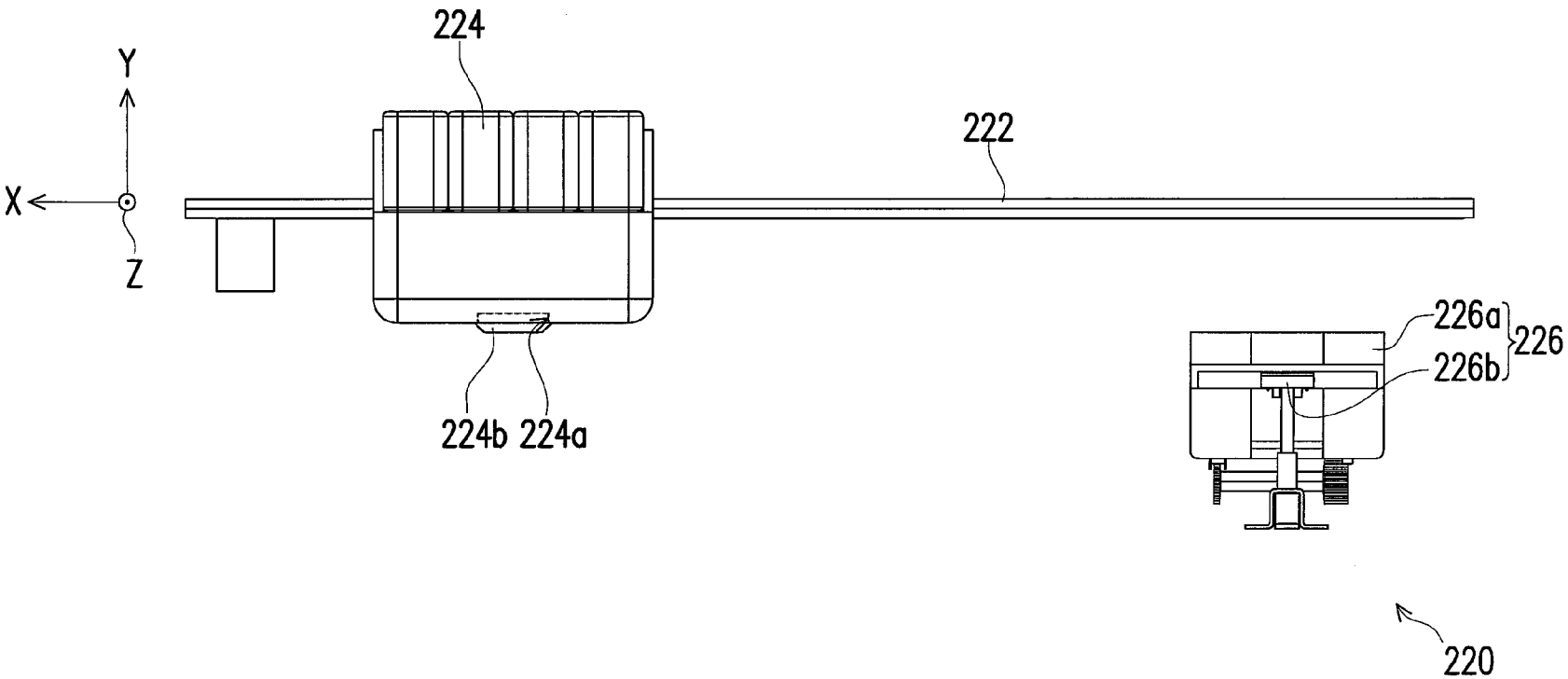
FIG. 5 to FIG. 7 are schematic breakdown views of a printer performing a printing process.
Figure 6:
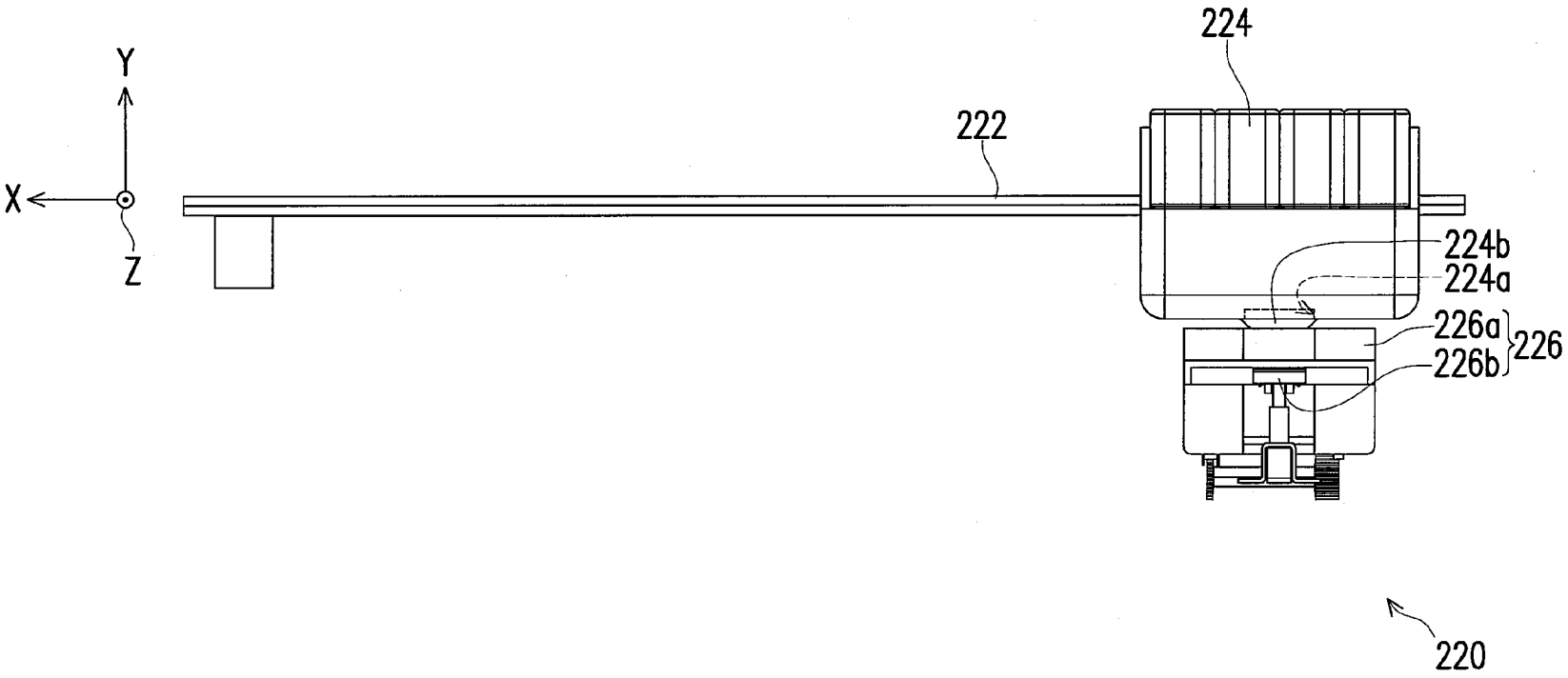
Figure 7:
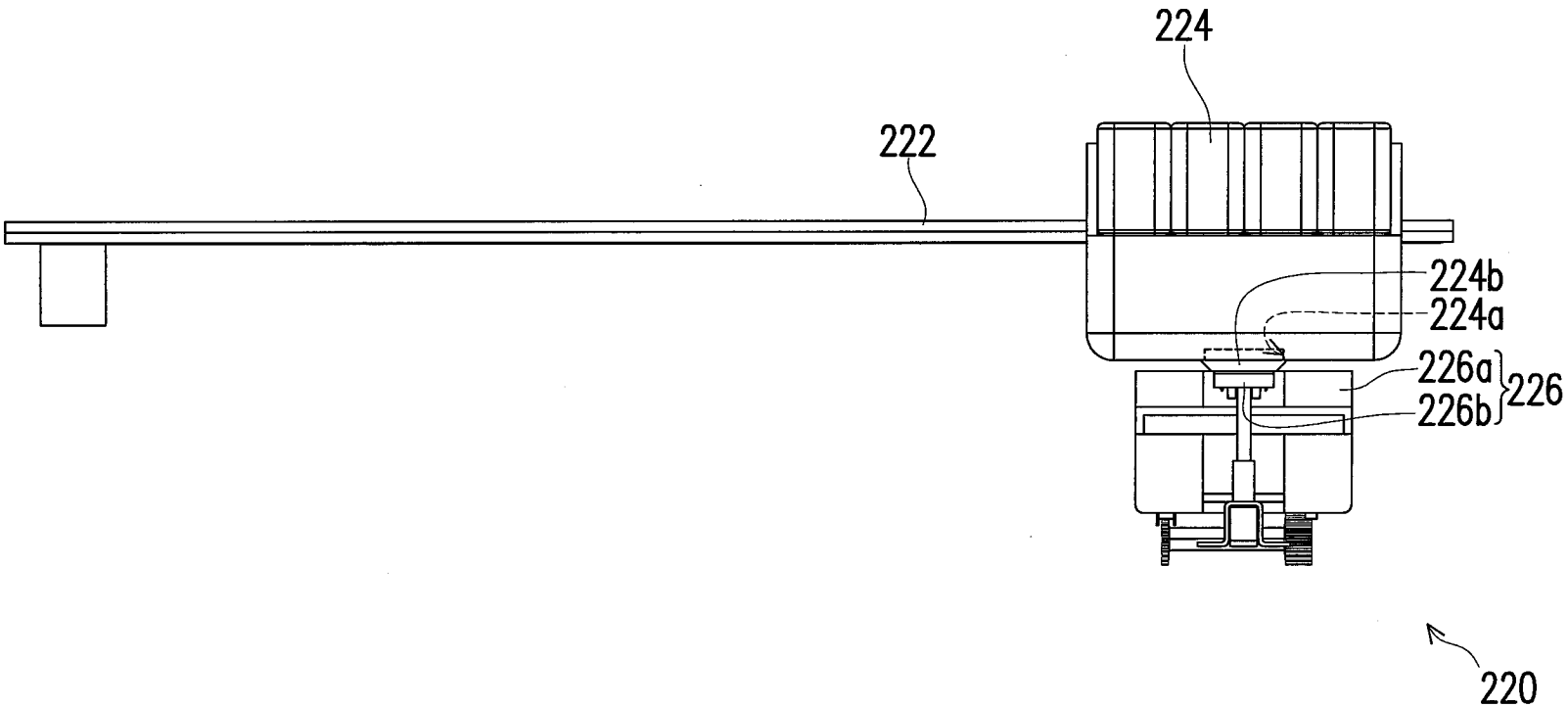

FIG. 5 to FIG. 7 are schematic breakdown views of a printer performing a printing process. Firstly referring to FIG. 5, when the printer 200 is performing a printing process, the electromagnet 224*b* is not conducted, so the inkjet module 224 may move back and forth along the axial direction (X-direction) of the shaft 222.

Next, referring to FIG. 6, when the printing process is finished, the inkjet module 224 moves to a location above the cleaning module 226, meanwhile, the scraper 226*a* of the cleaning module 226 is interfered with the nozzle 224*a* so as to perform a cleaning process on the nozzle 224*a*, i.e., scraping the residuary ink on the nozzle 224*a*. At this time, the electromagnet 224*b* is not conducted to generate the magnetic attraction attracting the cap 226*b* with magnetism, so the cap 226*b* generally does not actively approach to and be engaged with the nozzle 224*a*.

It is noted that, in order to prevent the magnetism of the electromagnet 224*b* from enabling the cap 226*b* to move upward and attract the nozzle 224*a* when the electromagnet 224*b* is not conducted, the electromagnet 224*b* may further be conducted such that the electromagnet 224*b* generates the magnetic force repelling the cap 226*b* with magnetism.

Then, referring to FIG. 7, after the scraper 226*a* finishes performing the cleaning process on the nozzle 224*a*, the cap 226*b* is relatively close to the nozzle 224*a*, wherein the cap 226*b* moves upward close to the nozzle 224*a* along Z-direction perpendicular to the axial direction (X-direction). Meanwhile, the electromagnet 224*b* is conducted to generate attraction attracting the cap 226*b* with magnetism, and the cap 226*b* seals the nozzle 224*a* by magnetic attraction.

Based on the above, the scraper 226*a* has already scraped the residuary ink on the nozzle 224*a*, so the nozzle 224*a* being jammed due to the residuary ink drying out may be prevented, and the cap 226*b* seals the nozzle 224*a* may further prevent the ink from drying out.

When the printing process is performed again, the electromagnet 224*b* is again conducted such that the electromagnet 224*b* generates the magnetic force repelling the cap 226*b* with magnetism to push the cap 226*b* away, and the cap 226*b* moves downward back to the initial position along Z-direction perpendicular to the axial direction (X-direction). Similarly, when the printing process is finished, the processes of scrapping the residuary ink and the cap 226*b* sealing the nozzle 224*a* described above are repeated.

When the printer 200 is turned off, because the electromagnet 224*b* is originally magnetic, even if the power of the printer 200 is turned off, the cap 226*b* with magnetism may still be attracted to the electromagnet 224*b* and maintain the status of sealing the nozzle 224*a*. Until the next time the printer 200 is turned on and performs the printing process, the electromagnet 224*b* is then conducted to generate the magnetic force repelling the cap 226*b* to push the cap 226*b* away.

Based on the description above, in the printing device 220 of the printer 200 of the present embodiment, the electromagnet 224*b* is disposed around the nozzle 224*a* to use the property of the electromagnet 224*b* to generate attraction or repellence between the electromagnet 224*b* and the cap 226*b* with magnetism by controlling the forward direction and the reverse direction of the current, so as to achieve the goal of the cap 226*b* sealing the nozzle 224*a* or the cap 226*b* away from the nozzle 224*a*.

Moreover, compared with the conventional printer, the cap 226*b* of the printing device 220 of the present embodiment is fixed along X-direction and Y-direction, and only moves back and forth along Z-direction, so as to ensure the sealing precision and the sealing degree when the cap 226*b* seals the nozzle 224*a*, also, significantly decrease the required time for sealing operation and the space for mechanism design, and diminish the instability and the risk caused by the mechanism composed of many transmitting components in the conventional printer.

Second Embodiment

Figure 8:
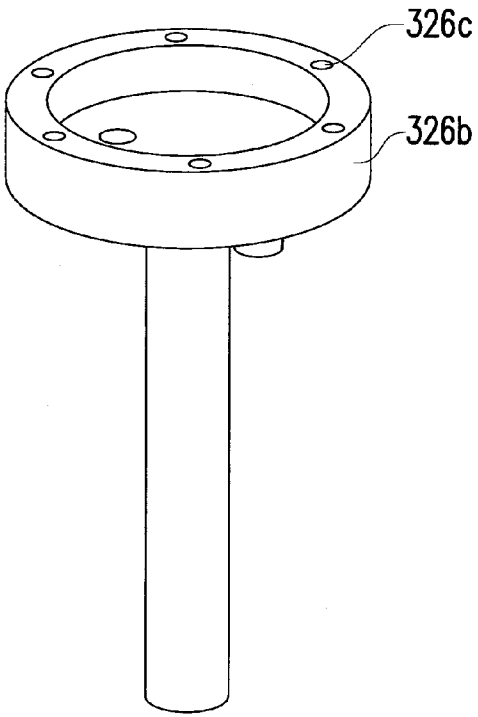
FIG. 8 is a schematic view of a cap of a cleaning module and a permanent magnet according to a second embodiment of the present invention.

FIG. 8 is a schematic view of a cap of a cleaning module and a permanent magnet according to a second embodiment of the present invention.

The present embodiment is approximately identical to the above-mentioned embodiment, and same or similar reference numerals represent the same or similar components. Referring to FIG. 7 and FIG. 8, the printer of the present embodiment includes a body 210 as described in the first embodiment and a printing device 220 disposed in the body 210, and the printing device 220 includes, as it is described in the first embodiment, a shaft 222, an inkjet module 224 disposed on the shaft to move back and forth along an axial direction of the shaft 222 and a cleaning module 226 for cleaning the residuary ink and sealing a nozzle 224*a*. The difference between the present embodiment and the above-mentioned embodiment is that the cap 326*b* of the cleaning module 226 is not magnetic and at least one permanent magnet 326*c* is engaged in the cap 326*b*, wherein the material of the permanent magnet 326*c* includes steel, iron, nickel, aluminum, cobalt, aluminum-nickel-cobalt alloy, titanium-cobalt alloy, platinum-cobalt alloy or rare-earth elements and cobalt alloy.

In detail, the material of the cap 326*b* may be plastic, and the surface of the permanent magnet 326*c* engaged in the cap 326*b* may be exposed by the cap 326*b*, i.e., the surface of the cap 326*b* opposite to the shaft 222 has at least one hole (not shown) such that the permanent magnet 326*c* is engaged in the hole (not shown), or the surface of the permanent magnet 326*c* is not exposed by the cap 326*b*, i.e., the permanent magnet 326*c* is buried in the cap 326*b*.

Similarly, after the scraper 226*a* finishes the cleaning process on the nozzle 224*a*, the cap 326*b* is relatively close to the nozzle 224*a*, and, at this time, the electromagnet 224*b* is conducted and attracts the permanent magnet 326*c* engaged in the cap 326*b*, such that the cap 326*b* seals the nozzle 224*a*.

In sum, in the printing device and the printer using the printing device of the present invention, the electromagnet is disposed around the nozzle so as to use the property of the electromagnet to generate attraction or repellence between the electromagnet and the cap with permanent magnet disposed therein or being magnetic by controlling the forward direction and the reverse direction of the current, so as to achieve the goal of the cap sealing the nozzle or the cap away from the nozzle.

Furthermore, the cleaning module does not need to move along X-direction, and only moves along Y-direction (the scraper scrapping the residuary ink on the nozzle) and Z-direction (the cap sealing the nozzle), and because the cap is fixed along X-direction and Y-direction and only moves along Z-direction when the cap seals the nozzle, the amount of the transmitting components in the conventional printer may be decreased, so as to diminish the instability caused by too many transmitting components. Furthermore, the sealing precision and the sealing degree when the cap seals the nozzle may further be ensured, and the required time for sealing operation and the space for mechanism design are significantly decreased.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A printing device, comprising:

a shaft;

an inkjet module, disposed on the shaft to move back and forth along an axial direction of the shaft, the inkjet module having a nozzle and at least one electromagnet, the electromagnet disposed around the nozzle; and a cleaning module, disposed below the shaft and comprising a scraper and a cap, the cap disposed at one side of the scraper and the cap being magnetic.

2. The printing device as claimed in claim 1, wherein when the inkjet module moves along the shaft to a location above the cleaning module, the scraper of the cleaning module performs a cleaning process on the nozzle, at the time, the electromagnet is conducted to be repelled by the cap.

3. The printing device as claimed in claim 2, wherein after the scraper finishes performing the cleaning process on the nozzle, the cap is relatively close to the nozzle, at this time, the electromagnet is conducted to attract the cap, such that the cap seals the nozzle.

4. The printing device as claimed in claim 1, wherein the material of the cap comprises magnetic material.

5. The printing device as claimed in claim 4, wherein the magnetic material comprises steel, iron, nickel, aluminum, cobalt, aluminum-nickel-cobalt alloy, titanium-cobalt alloy, platinum-cobalt alloy or rare-earth elements and cobalt alloy.

6. A printer, comprising:

a body;

a printing device, disposed in the body, comprising:

a shaft;

an inkjet module, disposed on the shaft to move back and forth along an axial direction of the shaft, the inkjet module having a nozzle and at least one electromagnet, the electromagnet disposed around the nozzle; and a cleaning module, disposed below the shaft and comprising a scraper and a cap, the cap disposed at one side of the scraper and the cap being magnetic.

7. The printer as claimed in claim 6, wherein when the inkjet module moves along the shaft to a location above the cleaning module, the scraper of the cleaning module performs a cleaning process on the nozzle, at the time, the electromagnet is conducted to repel the cap.

8. The printer as claimed in claim 7, wherein after the scraper finishes performing the cleaning process on the nozzle, the cap is relatively close to the nozzle, at this time, the electromagnet is conducted and attract the cap, such that the cap seals the nozzle.

9. The printer as claimed in claim 6, wherein the material of the cap comprises magnetic material.

10. The printer as claimed in claim 9, wherein the magnetic material comprises steel, iron, nickel, aluminum, cobalt, aluminum-nickel-cobalt alloy, titanium-cobalt alloy, platinum-cobalt alloy or rare-earth elements and cobalt alloy.

11. A printing device, comprising:

a shaft;

an inkjet module, disposed on the shaft to move back and forth along an axial direction of the shaft, the inkjet module having a nozzle and at least one electromagnet, the electromagnet disposed around the nozzle; and a cleaning module, disposed below the shaft and comprising a scraper, a cap and at least one permanent magnet, the cap disposed at one side of the scraper, wherein the permanent magnet is engaged in the cap, and when the inkjet module moves along the shaft to a location above the cleaning module, the position of the permanent magnet corresponds to the position of the electromagnet.

12. The printing device as claimed in claim 11, wherein when the inkjet module moves along the shaft to the location above the cleaning module, the scraper of the cleaning module performs a cleaning process on the nozzle, at the time, the electromagnet is conducted and repel the permanent magnet.

13. The printing device as claimed in claim 12, wherein after the scraper finishes performing the cleaning process on the nozzle, the cap is relatively close to the nozzle, at this time, the electromagnet is conducted and attract the permanent magnet engaged in the cap, such that the cap seals the nozzle.

14. The printing device as claimed in claim 11, wherein the material of the permanent magnet comprises steel, iron, nickel, aluminum, cobalt, aluminum-nickel-cobalt alloy, titanium-cobalt alloy, platinum-cobalt alloy or rare-earth elements and cobalt alloy.

15. A printer, comprising:

a body;

a printing device, disposed in the body, comprising:

a shaft;

an inkjet module, disposed on the shaft to move back and forth along an axial direction of the shaft, the inkjet module having a nozzle and at least one electromagnet, the electromagnet disposed around the nozzle; and a cleaning module, disposed below the shaft and comprising a scraper, a cap and at least one permanent magnet, the cap disposed at one side of the scraper, wherein the permanent magnet is engaged in the cap, and when the inkjet module moves along the shaft to a location above the cleaning module, the position of the permanent magnet corresponds to the position of the electromagnet.

16. The printer as claimed in claim 15, wherein when the inkjet module moves along the shaft to the location above the cleaning module, the scraper of the cleaning module performs a cleaning process on the nozzle, at the time, the electromagnet is conducted and repel the permanent magnet.

17. The printer as claimed in claim 16, wherein after the scraper finishes performing the cleaning process on the nozzle, the cap is relatively close to the nozzle, at this time, the electromagnet is conducted and attract the permanent magnet engaged in the cap, such that the cap seals the nozzle.

18. The printer as claimed in claim 15, wherein the material of the permanent magnet comprises steel, iron, nickel, aluminum, cobalt, aluminum-nickel-cobalt alloy, titanium-cobalt alloy, platinum-cobalt alloy or rare-earth elements and cobalt alloy.

* * * * *